US006807394B2

(12) United States Patent
Yoo

(10) Patent No.: US 6,807,394 B2
(45) Date of Patent: Oct. 19, 2004

(54) APPARATUS FOR CONNECTING AND DISCONNECTING DEVELOPING BIAS POWER SUPPLY

(75) Inventor: Yong-baek Yoo, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/373,076

(22) Filed: Feb. 26, 2003

(65) Prior Publication Data

US 2003/0228169 A1 Dec. 11, 2003

(30) Foreign Application Priority Data

Jun. 11, 2002 (KR) ..... 10-2002-0032525

(51) Int. Cl.[7] ..... G03G 15/01; G03G 15/08

(52) U.S. Cl. ..... 399/228; 399/88; 399/90

(58) Field of Search ..... 399/88, 90, 75, 399/228, 227, 226, 225, 223, 222, 53, 54, 55, 229; 347/115

(56) References Cited

U.S. PATENT DOCUMENTS 5,521,693 A * 5/1996 Kojima et al. ..... 399/228
5,585,898 A * 12/1996 Fujii ..... 399/228
5,585,911 A * 12/1996 Hattori et al. ..... 399/227
5,646,721 A * 7/1997 Sugihara et al. ..... 399/227 X
5,828,934 A * 10/1998 Tamura et al. ..... 399/228
6,507,386 B2 * 1/2003 Inomata ..... 355/27
2003/0147671 A1 * 8/2003 Kishigami ..... 399/227

FOREIGN PATENT DOCUMENTS

JP 06-317981 * 11/1994
JP 2001-281950 * 10/2001

* cited by examiner

*Primary Examiner*—Sophia S. Chen
(74) *Attorney, Agent, or Firm*—Staas & Halsey LLP

(57) ABSTRACT

An apparatus for connecting and disconnecting a developing bias power supply in an image forming system. A plurality of developers are operated in sequence to develop an electrostatic latent image formed on a photosensitive body in a predetermined color. An electro-magnetic clutch, which corresponds to each of the developers, connects and disconnects driving of each of the developers. A deceleration gear assembly is rotated according to a rotation of a gear of the developer connected to the electro-magnetic clutch. A connection unit, which is driven by the deceleration gear assembly, rotates and connects/disconnects the developing bias power supply to/from each of the developers.

16 Claims, 7 Drawing Sheets

APPARATUS FOR CONNECTING AND DISCONNECTING DEVELOPING BIAS POWER SUPPLY

CROSS REFERENCE TO RELATED APPLICATIONS

This application claims the priority of Korean Patent Application No. 2002-32525, filed Jun. 11, 2002, in the Korean Intellectual Property Office, the disclosure of which is incorporated herein by reference.

BACKGROUND OF THE INVENTION

1. Field of the Invention

The present invention relates to an apparatus for connecting and disconnecting a developing bias power supply and, more particularly, to an apparatus for connecting and disconnecting a developing bias power supply in an image forming system in which a developing unit is spaced apart from a photosensitive body by a predetermined distance.

2. Description of the Related Art

In general, an electrophotographic printer such as a color laser printer, has an image forming apparatus, which forms an electrostatic latent image on a photosensitive body, develops the electrostatic latent image with toner using a developing unit, transfers the developed image onto paper via a transfer body, heats and pressurizes the paper, and completely fixes the transferred image on the paper.

FIG. 1 shows an example of an image forming system for such an electrophotographic printer.

The image forming system includes a photosensitive drum 10 as a photosensitive body; a charger 11 which charges the surface of the photosensitive drum 10 at a predetermined potential; a laser scanning unit (LSU) 12 as an exposing unit, which radiates light onto the charged photosensitive drum 10 and forms an electrostatic latent image; a developing unit 13 which develops the electrostatic latent image with toner having four colors such as yellow (Y), magenta (M), cyan (C), and black (K) into a predetermined toner image; a transfer belt 14 which sequentially overlaps the toner image having four colors developed on the photosensitive drum 10; a first transfer roller 14*a* which transfers the image developed on the photosensitive drum 10 onto the transfer belt 14; a second transfer roller 14*b* which transfers the image having four colors overlapped on the transfer belt 14 onto a piece of paper; and a fusing unit 15 which heats the paper at a predetermined temperature, pressurizes the paper and fixes the transferred image on the paper. Four developers 13-Y, 13-M, 13-C, and 13-K are provided in the developing unit 13. The four developers 13-Y, 13-M, 13-C, and 13-K are elastically biased in a direction that is spaced apart from the photosensitive drum 10 by a predetermined gap, selectively move toward the photosensitive drum 10 by rotation of cams 13*b*-Y, 13*b*-M, 13*b*-C and 13*b*-K, respectively, and allow developing rollers 13*a*-Y, 13*a*-M, 13*a*-C, and 13*a*-K, respectively, provided at a front end of the developer to contact the photosensitive drum 10. Reference numerals 16, 17, 18, and 19 denote a paper cassette, a photosensitive drum cleaning blade, an eraser, and a paper ejecting route, respectively.

In the above structure, an image forming process will be performed as described below.

If the photosensitive drum 10 is charged by the charger 11, the LSU 12 radiates light onto the photosensitive drum 10, thereby forming an electrostatic latent image of an image to be developed as a first color. For example, if an image of yellow color is first developed, the developer 13-Y of yellow color accesses the photosensitive drum 10 through being driven by a corresponding cam 13*b*-Y, thereby developing the electrostatic latent image formed on the photosensitive drum 10 with toner of yellow color, as shown in FIG. 2. Toner T on the outer surface of a developing roller 13*a*-Y is transferred to a portion of the electrostatic latent image of the photosensitive drum 10 that contacts the developing roller 13*a*-Y. A yellow image developed in the above manner is transferred onto the transfer belt 14 via a first transfer nip N1 (FIG. 1). Subsequently, a second color electrostatic latent image is formed by charging and exposing the photosensitive drum 10. If a second color is magenta, the developer 13-M of magenta color accesses the photosensitive drum 10, thereby developing an electrostatic latent image. A magenta image developed in this way is superimposed onto the photosensitive drum 10 and transferred onto the transfer belt 14 onto which the yellow image has been transferred. Similarly, a third image of cyan color and a fourth image of black color are developed and transferred, thereby a desired color image is finally formed on the transfer belt 14. Subsequently, the completed color image is transferred onto the paper fed to a second transfer nip N2 between the transfer belt 14 and the second transfer roller 14*b*, is heated and pressured by the fusing unit 15, and is completely fixed on the paper.

However, in the above structure, the four-color developers 13-Y, 13-M, 13-C, and 13-K of the developing unit 13 alternately contact with and separate from the photosensitive drum 10 to develop images. Thus, whenever the developing rollers 13*a*-Y, 13*a*-M, 13*a*-C and 13*a*-K of the developers 13-Y, 13-M, 13-C, and 13-K, respectively, collide with the photosensitive drum 10, the collision may shock the photosensitive drum 10, causing a jitter error in which an image jitters.

Accordingly, to fundamentally solve problems of the development method, it is preferable to employ a developing unit for performing a development step, in which the developers 13-Y, 13-M, 13-C, and 13-Y are secured to be spaced apart from the photosensitive drum 10 by a predetermined gap. An example thereof is shown in FIG. 3. In the description of FIG. 3, reference numerals which are the same as reference numerals used in FIG. 1 refer to the same elements as those in FIG. 1, and further descriptions thereof will be omitted.

Referring to FIG. 3, an image forming system does not include a cam which mechanically contacts each of developers 20-Y, 20-M, 20-C, and 20-K to the photosensitive drum 10, and the developers 20-Y, 20-M, 20-C, and 20-K are spaced apart from the photosensitive drum 10 by a predetermined gap. A respective toner-supplying roller, a respective seal blade, a respective doctor blade and a respective developing roller (21*a*-Y, 21*a*-M, 21*a*-C and 21*a*-K) are provided in each of the developers 20-Y, 20-M, 20-C, and 20-K. A plurality of switches (not shown) and a connection circuit are used in each of the developers 20-Y, 20-M, 20-C, and 20-K to connect a high voltage power supply to the respective developing rollers 21*a*-Y, 21*a*-M, 21*a*-C and 21*a*-K, the corresponding toner-supplying roller, and the corresponding doctor blade when the developers 20-Y, 20-M, 20-C, and 20-K are used, and to disconnect the high voltage power supply from the developing rollers 21*a*-Y, 21*a*-M, 21*a*-C and 21*a*-K, the toner-supplying rollers, and the doctor blades when the developers 20-Y, 20-M, 20-C, and 20-K are not used. Hence, the structure of each developer becomes complicated.

SUMMARY OF THE INVENTION

The present invention provides an apparatus for connecting and disconnecting a developing bias power supply that supplies a high voltage to each developer of an image forming system in which the developers are secured to be spaced apart from a photosensitive drum by a predetermined gap.

According to one aspect of the present invention, there is provided an apparatus for connecting and disconnecting a developing bias power supply in an image forming system, which operates a plurality of developers in sequence and develops an electrostatic latent image formed on a photosensitive body in a predetermined color. The apparatus comprises a plurality of electro-magnetic clutches, each clutch being provided to correspond to a respective developer to connect and disconnect driving of the respective developer. A deceleration gear assembly, which is rotated according to the rotation of a gear of the respective developer connected to the respective electro-magnetic clutch, and a connection unit, which is connected to the deceleration gear assembly, rotate to connect/disconnect a developing bias power supply to/from the respective developer.

The connection unit for connecting and disconnecting the developing bias power supply of each of the developers may comprise a cylindrical drum, conductive bands which are spaced apart from each other by a predetermined gap in a longitudinal direction of the cylindrical drum, each conductive band having a non-conductive opening or gap in a circumferential direction of the cylindrical drum, and terminals, a pair of which is formed to correspond to each of the conductive bands, to contact the conductive bands, and thus be electrically connected.

One of each pair of the terminals may be connected to one of the developers, and the other one of the pair of terminals may be connected to a high voltage power supply. The apparatus may further comprise leads which extend in a direction of the conductive bands from the terminals and contact the conductive bands.

According to another aspect of the present invention, there is provided an apparatus for connecting and disconnecting a developing bias power supply in an image forming system, which operates a plurality of developers in sequence and develops an electrostatic latent image formed on a photosensitive body in a predetermined color. The apparatus comprises a plurality of electro-magnetic clutches which are provided to correspond to a respective one of the developers and to connect and disconnect rotation of the respective one of the developers, a deceleration gear assembly, which is rotated according to the rotation of a gear of the developer connected to a respective electro-magnetic clutch, and at least one connection unit, which is connected to the deceleration gear assembly, rotates to connect the developing bias power supply to/from at least one of the developers.

BRIEF DESCRIPTION OF THE DRAWINGS

The above and/or other aspects and advantages of the present invention will become more apparent by describing in detail embodiments thereof with reference to the accompanying drawings in which.

DESCRIPTION OF THE PREFERRED EMBODIMENTS

Figure 1:
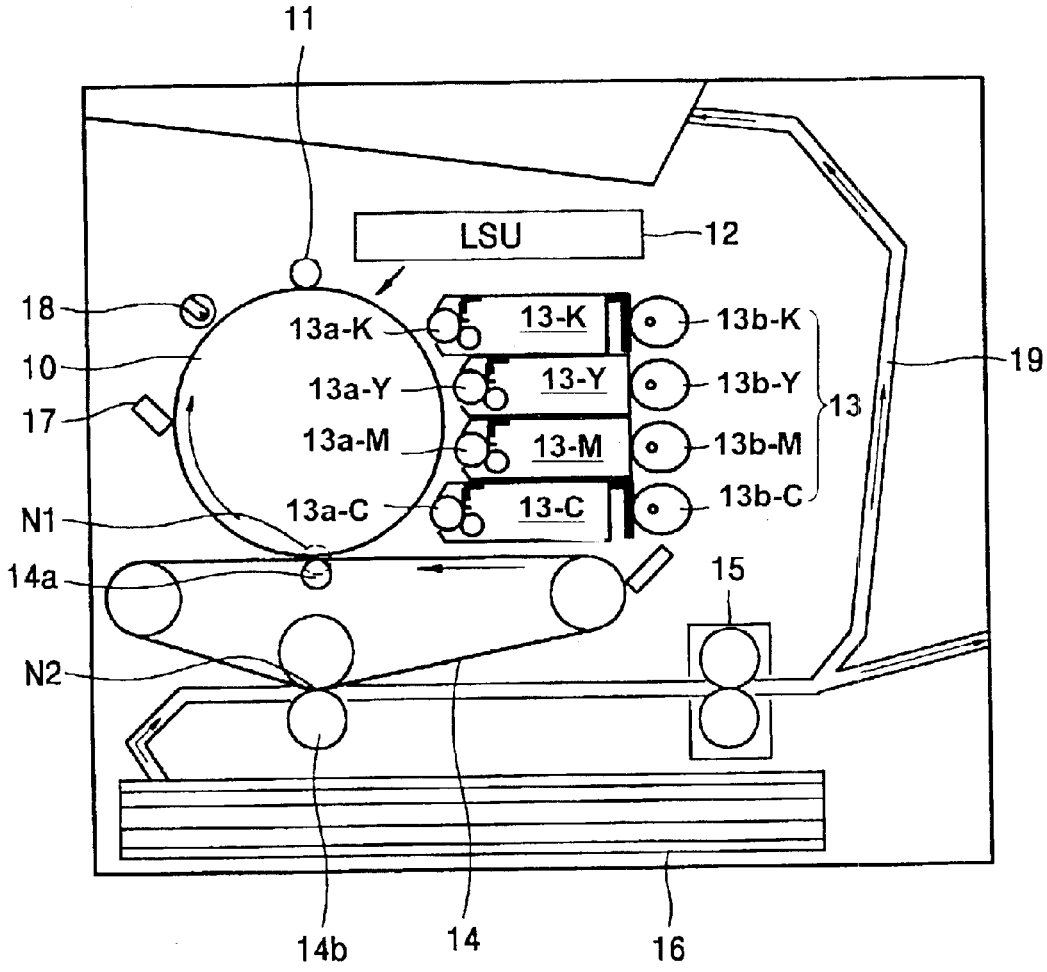
FIG. 1 (PRIOR ART)
FIG. 1 shows an example of a conventional image forming system for an electrophotographic printer.
Figure 2:
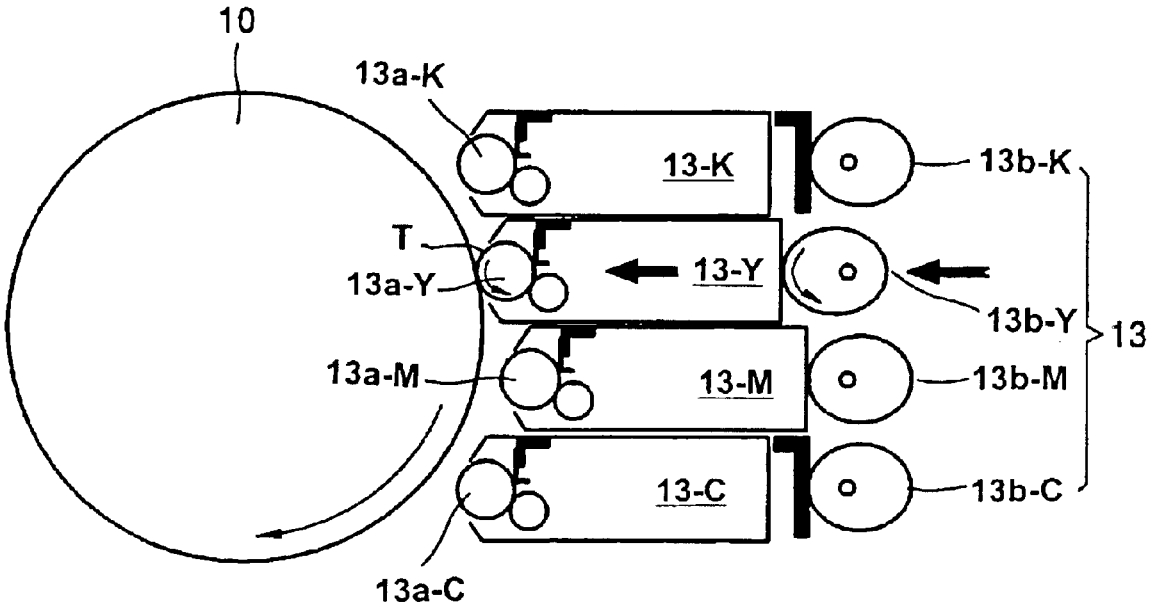
FIG. 2 (PRIOR ART)
FIG. 2 shows contacting and separating operations of a developing unit of the conventional image forming system of FIG. 1.

Reference will now be made in detail to the present embodiments of the present invention, examples of which are illustrated in the accompanying drawings, wherein like reference numerals refer to like elements throughout.

Figure 3:
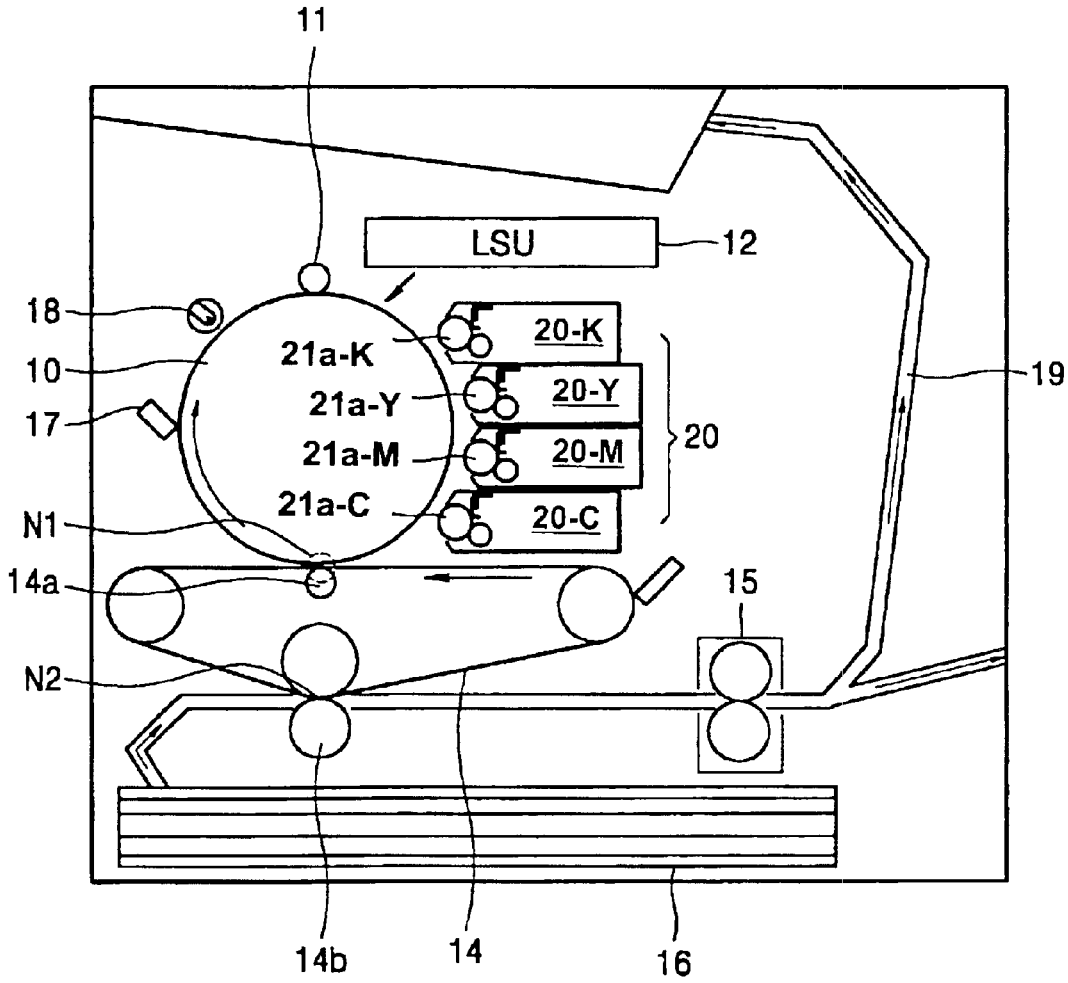
FIG. 3 (PRIOR ART)
FIG. 3 shows an example of another conventional image forming system for an electrophotographic printer.
Figure 4:
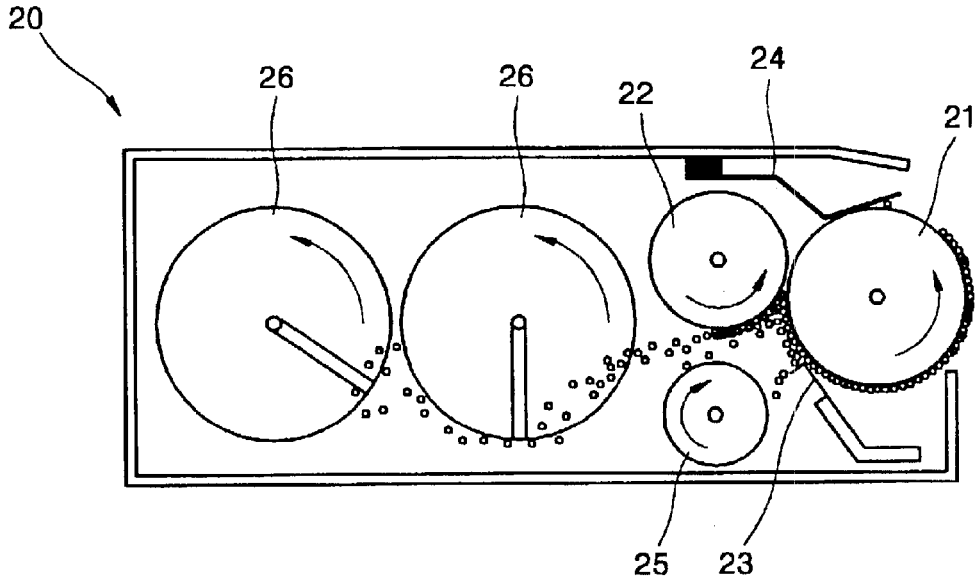
FIG. 4 schematically shows a structure of a developer according to a first embodiment of the present invention.
Figure 5:
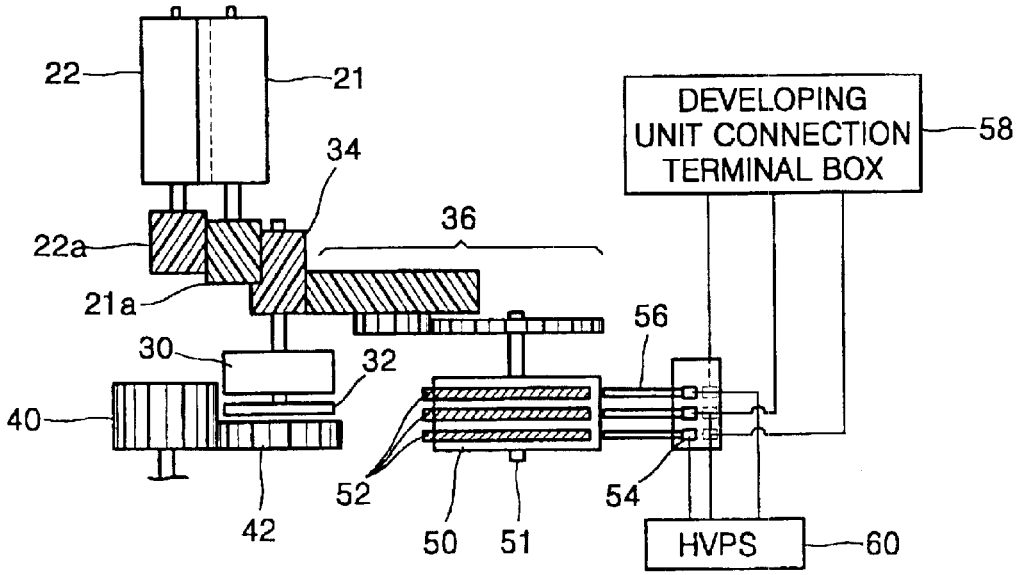
FIG. 5 shows an apparatus for connecting and disconnecting a developing bias power supply according to an embodiment of the present invention.

FIG. 4 schematically shows a developer according to a first embodiment of the present invention, and FIG. 5 shows a first embodiment of an apparatus for connecting and disconnecting a developing bias power supply according to the present invention. An image forming system according to the present invention will be described with reference to the image forming system of FIGS. 3, 4 and 5.

Four developers 20-Y, 20-M, 20-C, and 20-K, spaced apart from a surface of a photosensitive drum 10 by a predetermined distance, are provided in the image forming system. Referring now to FIG. 4, a representative one of the developers 20-Y, 20-M, 20-C and 20-K is shown. In the description of FIG. 4, suffixes Y, M, C and K, corresponding to toner color are not used in order to simplify the description. Each of the four developers 20-Y, 20-M, 20-C, and 20-K comprises a developing roller 21 which develops an electrostatic latent image of the photosensitive drum 10, a supplying roller 22 which supplies toner to the developing roller 21, a doctor blade 23 which regulates a height of the toner which attaches to the developing roller 21, a seal blade 24 which prevents the toner from scattering when the toner is withdrawn after the developing roller 21 performs a development operation, at least one agitator 26 which agitates the toner contained in the developer 20 and supplies the toner to the supplying roller 22, and a withdrawing roller 25 which withdraws the toner that remains after being regulated by the doctor blade 23.

A DC voltage of about −450 VDC and an AC voltage of about 2 kV having a frequency of about 2.0 kHz are applied to the developing roller 21 and to the doctor blade 23. As such, the toner attached to the developing roller 21 may be charged. In addition, DC voltages of about −650 VDC and about −350 VDC and an AC voltage of about 2 kV having the frequency of about 2.0 kHz are applied to the supplying roller 22 and the seal blade 24, respectively. The voltages are supplied to the developing roller 21, the supplying roller 22, the doctor blade 23, and the seal blade 24 from a high voltage power supply 60.

Referring to FIG. 5, a developing roller driving gear 21*a* and a supplying roller driving gear 22*a* are meshed with each other. The developing roller driving gear 21*a* is connected to an electro-magnetic clutch 30 and a clutch disc 32 via an idle gear 34. A connection gear 42 connected to a developer driving gear 40 is provided at one side of the clutch disc 32. The idle gear 34 is connected to a deceleration gear assembly 36, a rotation speed of which is decelerated at a predetermined rate. The deceleration gear assembly 36 is connected to a gear of an axis 51 of a cylindrical drum 50. Connection gears 42 respectively corresponding to each of the developers 20-Y, 20-M, 20-C, and 20-K are engaged with the developer driving gear 40. When the developer driving gear 40 rotates, the connection gears 42 are rotated. Thus, the electro-magnetic clutch 30 is selected and connected to the connection gear 42, which corresponds to each of the developers 20-Y, 20-M, 20-C, and 20-K, and thereby the rollers 21 and 22, the deceleration gear assembly 36, and the cylindrical drum 50 in the selected developer are driven and rotated.

Figure 6:
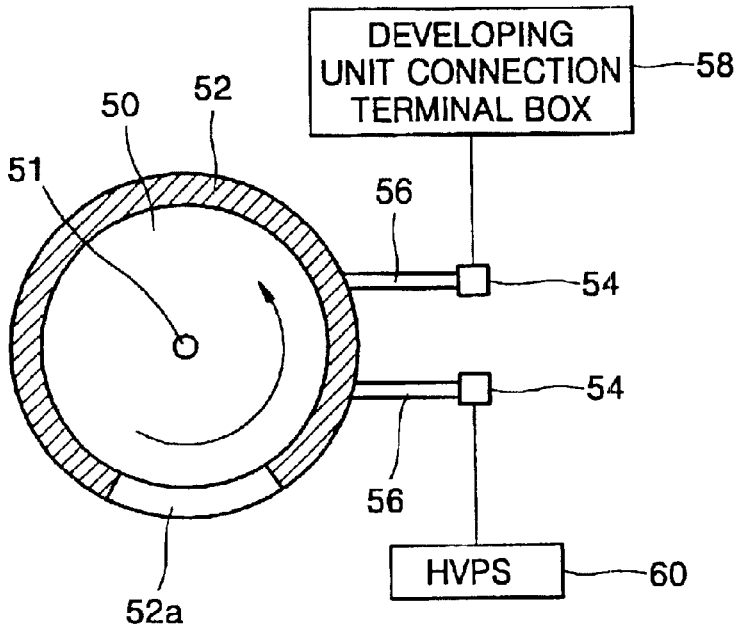
FIG. 6 shows a cylindrical drum and a terminal part of the apparatus shown in FIG. 5.
Figure 7:
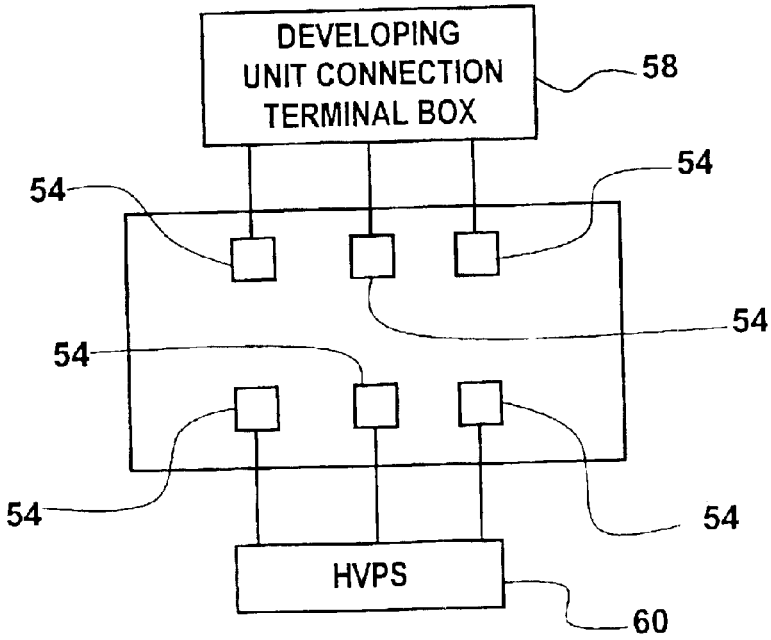
FIG. 7 shows an arrangement of terminals for connecting and disconnecting the developing bias power supply shown in FIG. 5.

FIG. 6 shows a cylindrical drum and a terminal part of FIG. 5, and FIG. 7 shows the arrangement of terminals. Three conductive bands 52 are formed on a circumferential surface of the cylindrical drum 50, each conductive band being formed to extend partially around the cylindrical drum 50 in a circumferential direction of the cylindrical drum 50 so that a non-conductive opening part or gap 52*a* exists in the band. First, second and third pairs of terminals 54 are spaced apart from the cylindrical drum 50 by a predetermined distance and arranged so each pair of terminals 54 corresponds to a respective one of the conductive bands 52. A lead 56 extends from each terminal 54 toward the corresponding conductive band 52. As such, a pair of terminals 54 corresponding to a respective conductive band 52 may be electrically connected by contact with the respective conductive band 52. One of the first pair of terminals 54 is electrically connected to the developing roller 21 and the doctor blade 23, one of the second pair of terminals 54 is electrically connected to the supplying roller 22, and one of the third pair of terminals 54 is electrically connected to the seal blade 24 through a developing unit connection terminal box 58. A second terminal of each of the first, second and third pairs of terminals 54 is connected to a corresponding output of the high voltage power supply (HVPS) 60. A combination of a terminal 54 and a lead 56 may be referred to as a contactor.

Operation of the apparatus for connecting and disconnecting a developing bias power supply of the image forming system having the above structure will be described in detail with reference to the attached drawings.

If the photosensitive drum 10 is charged by the charger 11, the LSU 12 radiates light onto the photosensitive drum 10, thereby forming an electrostatic latent image to be developed as a first color. For example, if an image of yellow color is first developed, the clutch disc 32 of the electro-magnetic clutch 30 is meshed with the connection gear 42 connected to the developer driving gear 40 so as to drive the developer 20-Y of yellow color. Subsequently, the idle gear 34 connected to the electro-magnetic clutch 30, the developing roller driving gear 21*a*, and the supplying roller driving gear 22*a* rotate. Meanwhile, while deceleration gears of the deceleration gear assembly 36 rotate by rotation of the idle gear 34, the cylindrical drum 50 connected to the deceleration gears rotates at a predetermined deceleration ratio. While the conductive bands 52 rotate when the cylindrical drum 50 rotates, the conductive bands 52 contact the leads 56 of the terminals 54, thereby electrically connecting each pair of terminals 54 which correspond to each of the conductive bands 52. Thus, the HVPS 60 is connected to the developing roller 21 and the doctor blade 23, the supplying roller 22, and the seal blade 24, thereby a predetermined developing bias voltage is supplied to the developing roller 21 and the doctor blade 23, the supplying roller 22, and the seal blade 24. As such, the toner supplied to the developing roller 21 from the supplying roller 22 passes through the doctor blade 23 and is regulated to a toner layer less than a predetermined height, thereby the electrostatic latent image formed on the photosensitive drum 10 is developed with toner of yellow color. The remaining toner is returned to a housing via the seal blade 24 by rotation of the developing roller 21. The withdrawing roller 25 withdraws the toner removed from the developing roller 21 by the doctor blade 23 and transfers the toner to the supplying roller 22. The toner T on the outer surface of the developing roller 13*a*-Y is transferred to a portion of the electrostatic latent image of the photosensitive drum 10. A yellow image developed in the above manner is transferred onto the transfer belt 14 via the first transfer nip N1.

Subsequently, if a yellow development operation is terminated, the clutch disc 32 of the electro-magnetic clutch 30 is moved away from the connection gear 42 such that the rollers 21 and 22, the operations of the deceleration gears of the deceleration gear assembly 36, and the cylindrical drum 50 in the developer 20-Y are stopped. In this case, when the cylindrical drum 50 stops, the leads 56 of the terminals 54 are placed in the opening part or gap 52*a* of the conductive bands 52 such that the connection of the terminals 54 is disconnected. Thus, the HVPS 60 is disconnected from the developing roller 21 and the doctor blade 23, the supplying roller 22, and the seal blade 24.

Subsequently, performing charge and exposure operations of the photosensitive drum 10 form a second color electrostatic latent image. If a second color is magenta, the electrostatic latent image of the photosensitive drum 10 is developed by the developer 20-M of magenta color. A magenta image developed in this way is superimposed onto the photosensitive drum 10 and transferred onto the transfer belt 14 onto which the yellow image has been transferred. In a similar way, a third cyan image and a fourth black image are developed and transferred, thereby a desired color image is finally formed on the transfer belt 14. Subsequently, the completed color image is transferred onto the paper fed to the second transfer nip N2 between the transfer belt 14 and the second transfer roller 14*b*, is heated and pressured by the fusing unit 15, and is completely fixed on the paper.

Figure 8:
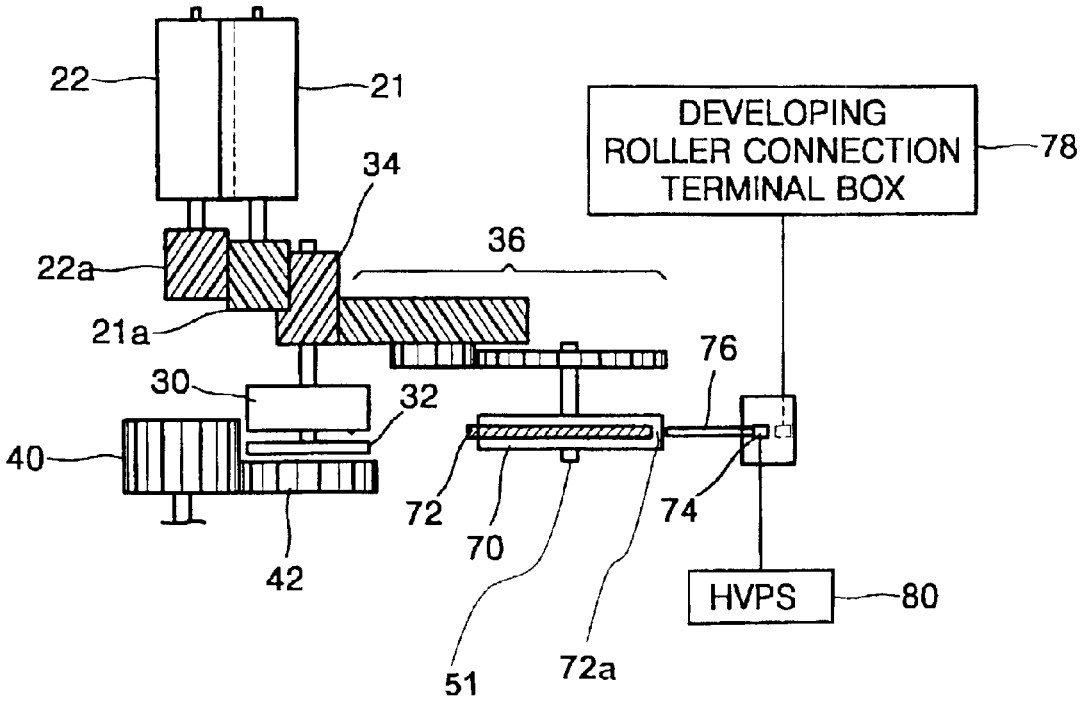
FIG. 8 schematically shows an apparatus for connecting and disconnecting a developing bias power supply according to a second embodiment of the present invention.

FIG. 8 schematically shows a second embodiment of the apparatus for connecting and disconnecting a developing bias power supply according to the present invention. Detailed descriptions of elements the same as those in the first embodiment will be omitted.

Figure 9:
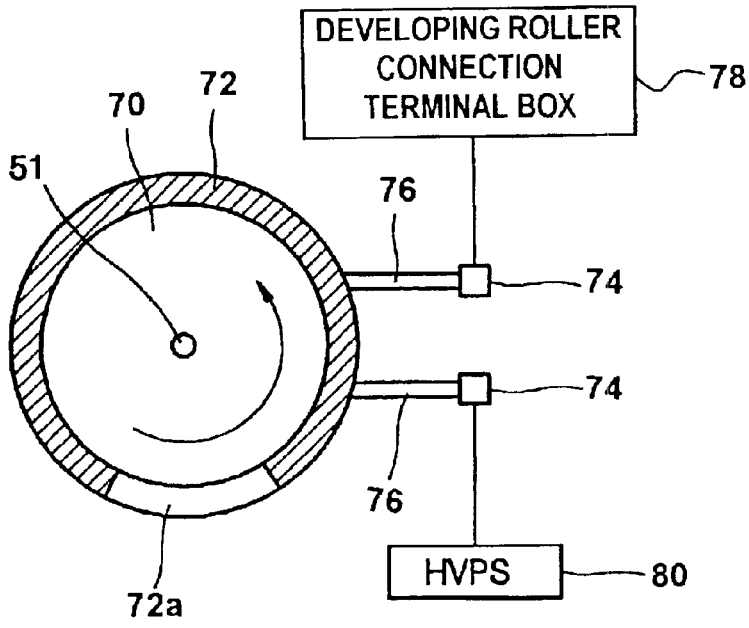
FIG. 9 shows a cylindrical drum and a terminal part of the apparatus shown in FIG. 8.
Figure 10:
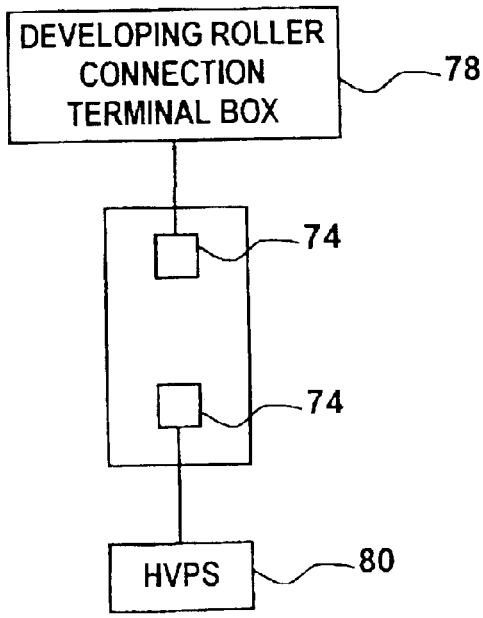
FIG. 10 shows an arrangement of terminals for connecting and disconnecting the developing bias power supply shown in FIG. 8.

Referring to FIGS. 8, 9 and 10, a conductive band 72 having a non-conductive opening part or gap 72*a* is formed on a circumferential surface of the cylindrical drum 70. Two terminals 74 spaced apart from the cylindrical drum 70 by a predetermined distance are arranged to correspond to the conductive band 72. A lead 76 extends from each terminal 74 toward the conductive band 72. As such, the terminals 74 contact the conductive band 72 and thus the terminals 74 are electrically connected and disconnected according to a rotation of the cylindrical drum and according to whether the leads 76 contact the conductive band 72 or the non-conductive gap 72*a*. One of the terminals 74 is connected to the developing roller 21 via a developing roller connection terminal box 78, and the other terminal 74 is connected to a high voltage power supply (HVPS) 80.

Among the developers 20-Y, 20-M, 20-C, and 20-K, arranged in the vicinity of the photosensitive drum 10, when a bias voltage is applied to one of the developers 20, a developing bias voltage of the developing roller 21 mainly affects a development operation of the other adjacent developers 20. Thus, when the one developer 20 operates, an apparatus for connecting and disconnecting only the developing bias voltage of the developing roller 21 of the other developers 20 is provided. A high voltage is continuously supplied to the other supplying roller 22, the seal blade 24, and the doctor blade 23 since the image forming system remains on until the image forming system is turned off. Thus, when the development operation of one developer is completed and the development operation of another developer 20 starts, only a high voltage of the developing roller 21 is connected/disconnected to/from each of the developers using an apparatus for connecting and disconnecting the HVPS 80.

As described above, the apparatus for connecting and disconnecting a developing bias power supply according to the present invention effectively connects and disconnects a high voltage power supply provided in the developer by connecting and disconnecting the electro-magnetic clutch. In addition, a circuit for connecting and disconnecting a developing bias power supply is simplified.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus for connecting and disconnecting a developing bias power supply in an image forming system, which operates a plurality of developers in sequence and develops an electrostatic latent image formed on a photosensitive body in a predetermined color, the apparatus comprising:

a driving gear which provides a rotational driving force;

at least one connection unit which rotates and connects/disconnects a developing bias power supply to/from at least one of the developers; and an electro-magnetic clutch which connects/disconnects driving of the at least one of the developers and the at least one connection to/from the driving gear.

2. The apparatus of claim 1, wherein the connection unit comprises:

a cylindrical drum which rotates;

conductive bands which are spaced apart from each other by a predetermined gap in a longitudinal direction of the cylindrical drum, each band having a non-conductive gap in a circumferential direction of the cylindrical drum; and contactors, arranged in pairs, each pair of the contactors corresponding to a respective one of the conductive bands, to contact the conductive bands and electrically connect the pairs of contactors according to the rotation of the cylindrical drum.

3. The apparatus of claim 2, further comprising a deceleration gear assembly which decelerates rotation of the cylindrical drum at a predetermined ratio.

4. The apparatus of claim 2, wherein one of each pair of the contactors is connected to a respective one of the developers, and the other of the pair of contactors is connected to a high voltage power supply.

5. The apparatus of claim 4, wherein each contactor further comprises:

a terminal which is spaced apart from the cylindrical drum;

a lead which extends from the terminal and contacts the corresponding conductive band.

6. An apparatus for connecting and disconnecting a developing bias power supply in an image forming system, which operates a developer and develops an electrostatic latent image formed on a photosensitive body, the apparatus comprising:

a deceleration gear assembly;

an electro-magnetic clutch which connects and disconnects the developer and the deceleration gear assembly from a rotational driving force; and a connection unit, which is rotationally coupled to the deceleration gear assembly and which rotates and connects/disconnects the developing bias power supply to/from the developer.

7. The apparatus of claim 6, wherein the connection unit comprises:

a cylindrical drum;

a conductive band which extends partially around the cylindrical drum in a circumferential direction; and contactors, a pair of which is formed to contact the conductive band, and thus be electrically connected where both contactors contact the conductive band.

8. The apparatus of claim 6, wherein the deceleration gear assembly decelerates transferred rotation at a predetermined ratio.

9. An apparatus for connecting and disconnecting a developing bias power supply in an image forming system, which operates a developer and develops an electrostatic latent image formed on a photosensitive body, each developer having a developing roller, the apparatus comprising:

a deceleration gear assembly;

an electro-magnetic clutch which connects and disconnects the developer and the deceleration pear assembly from a rotational driving force; and a connection unit, which is rotationally coupled to the deceleration gear assembly and which rotates and connects/disconnects the developing bias power supply to/from the developer, the connection unit comprising:

a cylindrical drum having a conductive band which extends partially around the cylindrical drum in a circumferential direction, and contactors, a pair of which is formed to contact the conductive band, and thus be electrically connected where both contactors contact the conductive band, wherein one of the pair of contactors is connected to one of the developing rollers, and the other of the pair of contactors is connected to the developing bias power supply.

10. The apparatus of claim 9, wherein each contactor comprises:

a terminal spaced apart from the cylindrical drum, and a lead which extends from the terminal to contact the conductive band.

11. An image forming system, comprising:

a plurality of developers which sequentially operate to develop an electrostatic latent image formed on a photosensitive body in a predetermined color, each developer having at least one roller operable by selectively coupling a rotational force to the roller;

a developing bias power supply which supplies a developer operating voltage;

at least one connection unit comprising a cylindrical drum which rotates simultaneously with at least one developer roller to connect/disconnect the operating voltage to/from at least one of the developers according to a rotational position of the cylindrical drum; and an electro-magnetic clutch which selectively couples the rotational force to the roller.

12. The image forming system of claim 11, further comprising:

a deceleration gear assembly which couples the at least one roller and the connection unit for simultaneous rotation.

13. An image forming system, comprising:

a plurality of developers which sequentially operate to develop an electrostatic latent image formed on a photosensitive body in a predetermined color, each developer having at least one roller operable by selectively coupling a rotational force to the roller;

a developing bias power supply which supplies a developer operating voltage; and at least one connection unit comprising:

a cylindrical drum which rotates simultaneously with at least one developer roller to connect/disconnect the operating voltage to/from at least one of the developers according to a rotational position of the cylindrical drum, at least one conductive band extending partially around the cylindrical drum and having a non-conductive gap and a pair of contactors, one of which is electrically connected with the at least one developer and another of which is connected to the developer operating voltage, wherein:

where both contactors contact the at least one conductive band, the at least one developer is connected with the developer operating voltage and where at least one of the contactors is positioned in the non-conductive gap of the at least one conductive band, the at least one developer is disconnected from the developer operating voltage.

14. An image forming system, comprising:

a developer which develops an electrostatic latent image formed on a photosensitive body in a predetermined color, the developer having a roller operable by selectively coupling a rotational force to the roller;

a developing bias power supply which supplies a developer operating voltage;

a cylindrical drum which rotates simultaneously with the developer roller to connect/disconnect the operating voltage to/from the developer according to a rotational position of the cylindrical drum; and an electro-magnetic clutch which selectively couples the rotational force to the roller.

15. An image forming system, comprising:

a developer which develops an electrostatic latent image formed on a photosensitive body in a predetermined color, the developer having a roller operable by selectively coupling a rotational force to the roller;

a developing bias power supply which supplies a developer operating voltage;

a cylindrical drum which rotates simultaneously with the developer roller to connect/disconnect the operating voltage to/from the developer according to a rotational position of the cylindrical drum; and a deceleration gear assembly which couples the roller and the connection unit for simultaneous rotation.

16. An image forming system, comprising:

a developer which develops an electrostatic latent image formed on a photosensitive body in a predetermined color, the developer having a roller operable by selectively coupling a rotational force to the roller;

a developing bias power supply which supplies a developer operating voltage; and a connection unit comprising:

a cylindrical drum which rotates simultaneously with the developer roller to connect/disconnect the operating voltage to/from the developer according to a rotational position of the connection unit, a conductive band extending partially around the cylindrical drum and having a non-conductive gaps, and a pair of contactors, one of which is electrically connected with the developer and another of which is connected to the developer operating voltage, wherein:

where both contactors contact the conductive band, the developer is connected with the developer operating voltage and where at least one of the contactors is positioned in the non-conductive gap, the developer is disconnected from the developer operating voltage.

* * * * *

UNITED STATES PATENT AND TRADEMARK OFFICE

CERTIFICATE OF CORRECTION

PATENT NO. : 6,807,394 B2
DATED : October 19, 2004
INVENTOR(S) : Yong-baek Yoo

It is certified that error appears in the above-identified patent and that said Letters Patent is hereby corrected as shown below:

Column 8,
Line 35, change “pear” to -- gear --.

Column 10,
Line 34, change “gaps” to -- gap --.

Signed and Sealed this

Third Day of May, 2005

JON W. DUDAS
*Director of the United States Patent and Trademark Office*